US006802744B2

(12) United States Patent
Chiang

(10) Patent No.: US 6,802,744 B2
(45) Date of Patent: Oct. 12, 2004

(54) WIRE MANAGEMENT MEMBER AND ELECTRIC CABLE CONNECTOR WITH WIRE MANAGEMENT MEMBER

(75) Inventor: Chun-Hsiang Chiang, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 13 days.

(21) Appl. No.: 09/960,172

(22) Filed: Sep. 21, 2001

(65) Prior Publication Data

US 2002/0039848 A1 Apr. 4, 2002

(30) Foreign Application Priority Data

Sep. 29, 2000 (TW) ..... 89216967 U

(51) Int. Cl.[7] ..... H01R 13/502
(52) U.S. Cl. ..... 439/701; 439/942
(58) Field of Search ..... 439/701, 392, 439/626, 709, 660, 723, 874, 460, 465, 470, 472, 742, 492

(56) References Cited

U.S. PATENT DOCUMENTS 5,957,732 A * 9/1999 Ito et al. ..... 439/701
6,039,611 A * 3/2000 Yang ..... 439/701
6,083,056 A * 7/2000 Okabe et al. ..... 439/598
6,231,392 B1 * 5/2001 van Woensel ..... 439/353
6,332,812 B1 * 12/2001 Kazuhara ..... 439/701
6,340,316 B2 * 1/2002 Nagai ..... 439/701

FOREIGN PATENT DOCUMENTS

JP 06-231836 * 8/1994 ..... H01R/23/66
KR 1995-0023686 8/1995
KR 1999-005424 6/1997

* cited by examiner

*Primary Examiner*—Gary Paumen
*Assistant Examiner*—Edwin A. Leon
(74) *Attorney, Agent, or Firm*—Robert J. Zeitler

(57) ABSTRACT

An electric cable connector includes a connector housing, a cable, and a wire management member. The connector housing includes a plurality of terminals, the terminals each having a tail extending out of one end of the connector housing for electrically soldering to respective wires of the cable. The wire management member is joined to the connector housing, and includes a plurality of terminal grooves adapted to receive the tail of each of the terminals, thereby preventing the tail of each terminal from being suspended in the air, and a plurality of wire grooves adapted to receive the wires of the cable for enabling the wires to be respectively positively soldered to the tail of each of the terminals. Positioning rods are also included on the wire management member to be received within cavities in the connector housing.

22 Claims, 2 Drawing Sheets

WIRE MANAGEMENT MEMBER AND ELECTRIC CABLE CONNECTOR WITH WIRE MANAGEMENT MEMBER

FIELD OF THE INVENTION

The present invention relates to an electric cable connector and, more particularly, to a wire management member for use with an electric cable connector.

BACKGROUND OF THE INVENTION

Electric cable connectors generally comprise a rectangular, electrically insulative connector housing. The connector housing includes a plurality of terminals. The terminals each have a tail extending out of one end of the connector housing and suspending in the open air for soldering to respective wires of an electric cable. Because the tail of each of the terminals is respectively suspending in the open air, it is difficult to solder the wires of the electric cable to the tail of each of the terminals, and one wire of the electric cable may be soldered to two or more terminals accidentally.

SUMMARY OF THE INVENTION

The present invention has been accomplished to provide an electric cable connector, which eliminates the aforesaid problems.

It is an object of the present invention to provide an electric cable connector which has a wire management member to receive and support the tail of each terminal, preventing the tail of each terminal from breaking due to suspension in the open air.

It is another object of the present invention to provide an electric cable connector which has a wire management member to receive and support the wires of the electric cable, keeping the wires of the cable arranged in good order for soldering to the tail of each of the terminals accurately and rapidly.

It is still another object of the present invention to provide an electric cable connector with a wire management member that keeps the wires of the electric cable isolated from one another to achieve better electric properties.

It is still another object of the present invention to provide an electric cable connector with a wire management member having one or more positioning rods extending from a surface of the wire management member to be receiving within a respective cavity with the connector housing, as compared to prior art connectors having a wire management member that engages a recess in an outer wall of the connector housing. Such a configuration is particularly advantageous in very small connectors where it is not practical to have a wire management system engage an outer wall of the connector body. Moreover, the present invention is advantageous over the prior art because the tooling for manufacturing the connector housing and wire management member can be simplified.

To achieve these and other objects of the present invention, an electric cable connector is provided comprised of a connector housing, a cable, and a wire management member. The connector housing includes terminals inserted therein. Each of the terminals has a tail extending out of one end of the connector housing for electrically soldering to respective wires of the cable. The wire management member is joined to the connector housing by positioning rods that are received within housing cavities. The wire management member may include a plurality of terminal grooves adapted to receive the tail of each of the terminals, thereby preventing the tail of each terminal from being suspended in the air, and a plurality of wire grooves adapted to receive the wires of the cable for enabling the wires to be respectively positively soldered to the tail of each of the terminals. Ribs may be located between adjacent terminal grooves to prevent solder intended from one of the terminals to migrate to other of the terminals. The wire management member can be made having multiple platforms disposed at different elevations to receive vertically spaced rows of terminals.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
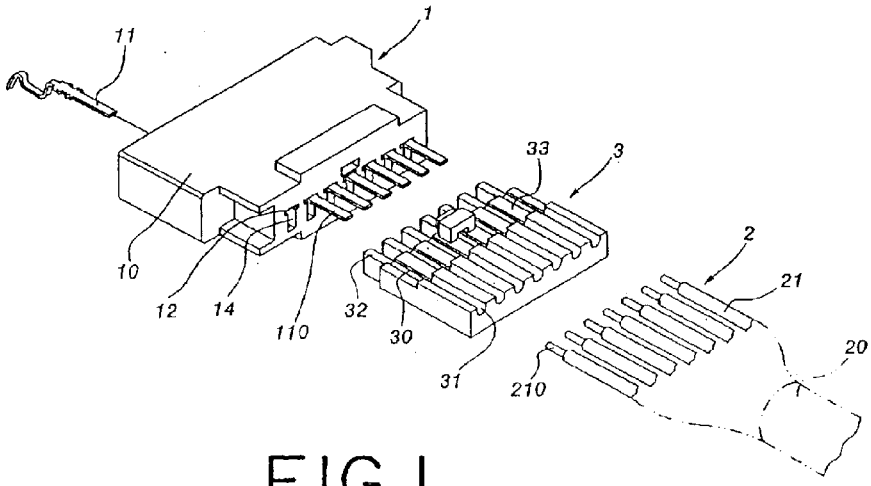
FIG. 1 is an exploded view of an electric cable connector according to a first embodiment of the present invention.
Figure 2:
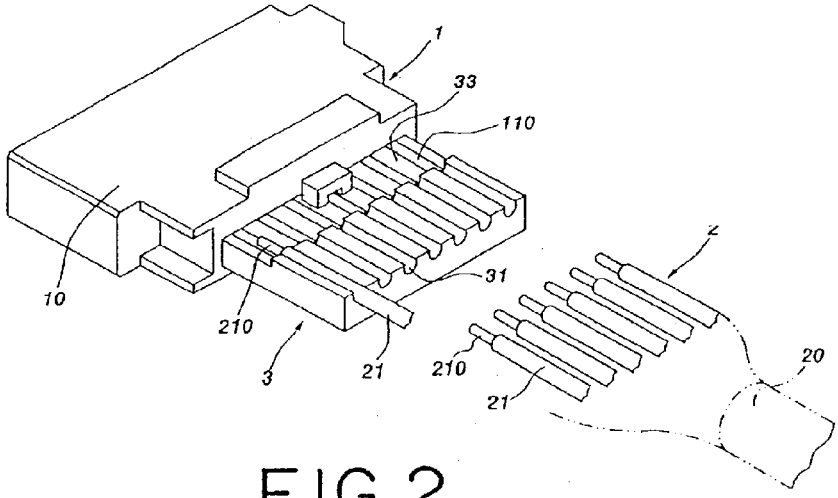
FIG. 2 is an assembly view of the electric cable connector according to the first embodiment of the present invention.
Figure 3:
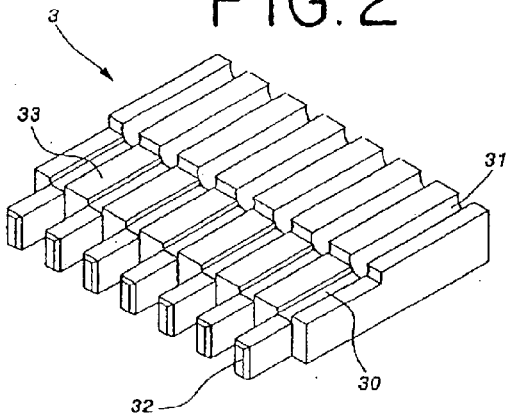
FIG. 3 is an oblique elevation of the wire management member for the electric cable connector according to the first embodiment of the present invention.

Referring to FIGS. 1 through 3, an electric cable connector in accordance with the present invention is generally comprised of a connector 1, a cable 2, and a wire management member 3. The connector 1 comprises an electrically insulative housing 10 having a plurality of outer walls, terminal passageways 12 within the housing and a plurality of terminals 11 respectively inserted into the terminal passageways 12. The connector may also include a metal shield (not shown) covering at least a portion of the housing 10. The electrically insulative housing 10 includes a plurality of locating cavities 14, the purpose of which will be explained later. The tail 110 of each of the terminals 11 respectively extends out of one of the outer walls of the housing 10 for soldering to the cable 2. The cable 2 comprises an electrically insulative jacket 20 and a plurality of wires 21 extended out of the jacket 20. Each wire 21 includes a metal conductor 210 soldered to the tail 110 of each of its corresponding terminal 11.

A wire management member 3 for use with the housing 10 comprises a body portion having a plurality of terminal grooves 30, a plurality of wire grooves 31, and one or more positioning rods 32 extending from an outer surface of the wire management member. In the embodiment shown in FIGS. 1–3, the positioning rods 32 extend from the front face of the wire management member 3 in a direction generally parallel to the terminal grooves 30. The positioning rods 32 are respectively received within respective locating cavities 14 of the housing 10 of the connector 1, thereby allowing the wire management member to be properly aligned with the body 10, and positively secured thereto. Although terminal passageway 12 and locating cavity 14 are shown in FIG. 1 to be joined, terminal passageway 12 and locating cavity 14 can be a separate from each other.

The terminal grooves 30 are adapted to receive the tail 110 of each of the terminals 11. Ribs 33, which may be integrally formed with the wire management member 3, are located between adjacent terminal grooves 30. The ribs 33 are higher than the elevation of the tail 110 of each of the terminals 11 received within the terminal grooves 30, so that the ribs 33 prevent solder paste from migrating to neighboring terminal grooves 30. One end of each of the terminal grooves 30 is respectively connected to the wire grooves 31. The wire grooves 31 in the embodiment shown have a cross section extending more than 180° for positively positioning and retaining the wires 21 of the cable 2 thereon. Once the wire 21 is properly positioned in its respective wire groove 31, the metal conductor 210 of the wire 21 is properly aligned with the terminal tail 110 to allow the conductor 210 to be soldered to the tail 110.

Figure 4:
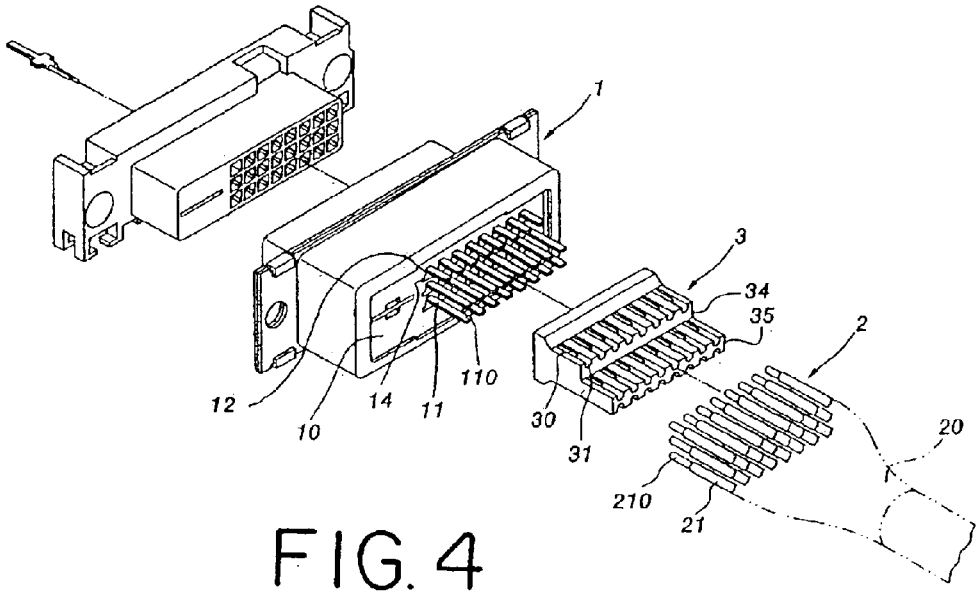
FIG. 4 is an exploded view of an electric cable connector according to a second embodiment of the present invention.
Figure 5:
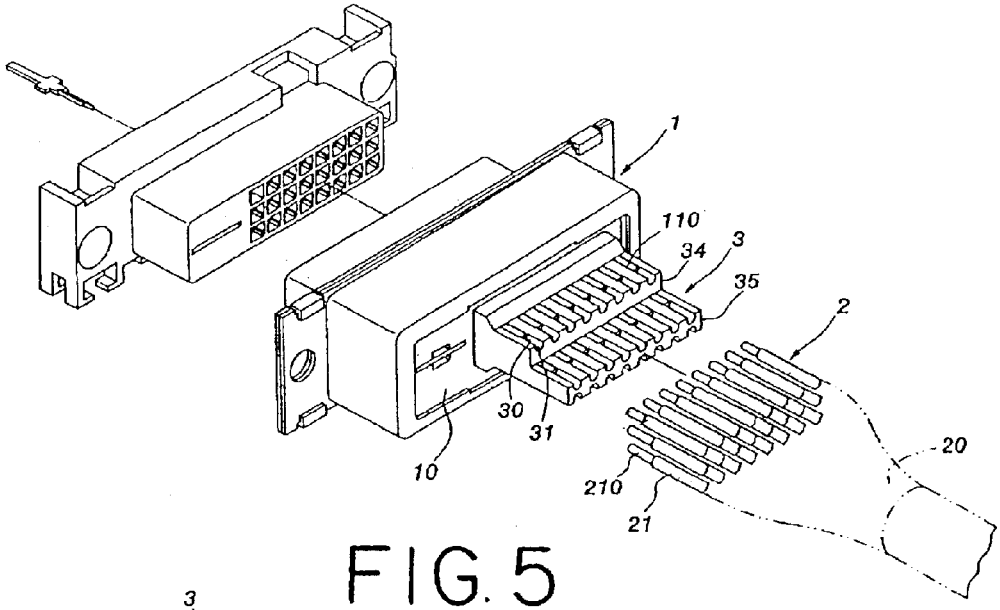
FIG. 5 is an assembly view of the electric cable connector according to the second embodiment of the present invention.
Figure 6:
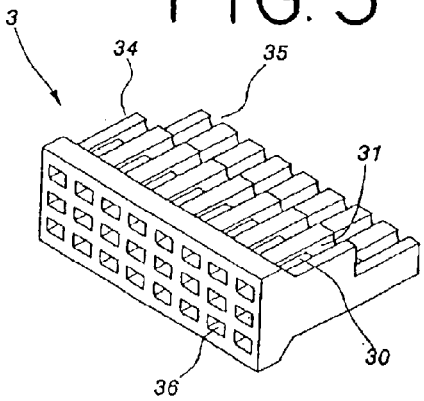
FIG. 6 is an oblique elevation of the wire management member for the electric cable connector according to the second embodiment of the present invention.

FIGS. 4 through 6 show an alternate form of the electric cable connector according to the present invention. One notable difference is that the connector shown in FIGS. 4–6 include more than one row of terminals 110. The housing 10 is molded from an electrically insulative plastic or the like, and includes a plurality of terminal receiving passageways 12, which holds the terminals 11 respectively, keeping the tail 110 of each of the terminals 11 extended out of the rear side of the housing 10 for soldering to the wires 21 of the cable 2. The housing also includes one or more cavities 14.

The wire management member 3 in this embodiment is a body portion including a stepped structure comprising two platforms 34 and 35 disposed at different elevations. The upper platform 34 has a grooved topside. The lower platform 35 has grooved top and bottom sides. Therefore, the wire management member 3 has three grooved faces. One common end of the platforms 34 and 35 is provided with terminal slots 36 for receiving the terminals 11. Terminal grooves 30 are respectively provided at the platforms 34 and 35 and extended to the terminal slots 36 for the positioning of the tail 110 of each of the terminals 11. The platforms 34 and 35 may be separately made, and then fastened together. Alternatively, the platforms 34 and 35 can be formed integral with each other. The terminal grooves 30 have a substantially U-shaped cross section. Wire grooves 31 are respectively provided at the platforms 34 and 35 in line with the terminal grooves 30 for receiving the wires 21 of the cable 2. Ribs 33 are provided at the platforms 34 and 35 to separate the terminal grooves 30 from one another and to prohibit migration of solder paste from one terminal groove 30 to another.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for use with an electrical cable having a plurality of wires, the electrical connector comprising:

a connector body, the connector body comprising a front side, a rear side, a cavity between said front side and said rear side, a plurality of terminal passageways, and a plurality of terminals respectively received within the terminal passageways, the terminals each having a tail extended out of said rear side of the connector body; and a wire management member, the wire management including a body portion having an end face, said body portion adapted to support the tail of each of the terminals, the wire management member comprising a projection rod projecting from said end face of the body portion, the projection rod being received within the connector body cavity.

2. The electrical connector of claim 1 wherein the wire management member body portion includes a plurality of wire grooves, the wire grooves adapted to receive the wires of the cable for enabling the wires of the cable to be respectively electrically soldered to the tail of each of the terminals.

3. The electrical connector of claim 1 wherein the cavity is contiguous with one of the plurality of terminal passageways.

4. An electrical connector as defined in claim 1, wherein the cavity is provided below the plurality of terminal passageways.

5. The electrical connector of claim 1 wherein the wire management member body portion includes a plurality of terminal grooves, the terminal grooves being adapted to receive the tail of each of the terminals.

6. The electrical connector of claim 5 wherein the wire management member comprises a plurality of ribs respectively disposed between two adjacent terminal grooves above the elevation of the tail of the terminals.

7. The electrical connector of claim 1 wherein the wire management member body portion comprises a plurality of platforms, at least one of the platforms comprising a plurality of terminal grooves adapted to receive the tail of each of the terminals.

8. The electrical connector of claim 7 wherein at least one of the platforms comprises a plurality of wire grooves adapted to receive the wires of the cable.

9. The electrical connector of claim 7 wherein at least one of the platforms includes a plurality of ribs respectively disposed between two adjacent terminal grooves above the elevation of the tail of the terminals.

10. A cable assembly, the assembly comprising:

a connector body, the connector body comprising a front side, a rear side, a cavity between said front side and said rear side, a plurality of terminal slots, and a plurality of terminals respectively mounted in the terminal slots, the terminals each having a tail extended out of said rear side of the connector body;

a cable, the cable comprising a plurality of wires respectively electrically soldered to the tail of each of the terminals; and a wire management member, the wire management member having an end face and being adapted to support the tail of each of the terminals, the wire management member comprising a projection rod projecting from said end face of the wire management member, the projection rod being received within the connector body cavity.

11. The cable assembly of claim 10 wherein the wire management member includes a plurality of terminal grooves, the terminal grooves being adapted to receive the tail of each of the terminals, and wherein a plurality of ribs are respectively disposed between two adjacent terminal grooves above the elevation of the tail of the terminals.

12. The cable assembly of claim 10 wherein the wire management member includes a plurality of wire grooves, the wire grooves adapted to receive the wires of the cable for enabling the wires of the cable to be respectively electrically soldered to the tail of each of the terminals.

13. The cable assembly of claim 10 wherein the wire management member comprises a plurality of platforms, each of the platforms comprising a plurality of terminal grooves adapted to receive the tail of each of the terminals.

14. The cable assembly of claim 13 wherein at least one of the platforms comprises a plurality of wire grooves adapted to receive the wires of the cable.

15. The cable assembly of claim 13 wherein at least one of the platforms includes a plurality of ribs respectively disposed between two adjacent terminal grooves above the elevation of the tail of the terminals.

16. A wire management member for use with an electrical connector having a connector body, the connector body comprising a front side, a rear side, a cavity between said front side and said rear side, a plurality of terminal slots, and a plurality of terminals respectively mounted in the terminal slots, the terminals each having a tail extended out of said rear side of the connector body, the wire management member comprising:

a body portion, the body portion having an end face, said body portion including a plurality of terminal grooves, the terminal grooves being adapted to receive the tail of each of the terminals; and a projection rod, the projection rod projecting from said end face of the body portion, the projection rod being adapted to be received within the connector body cavity.

17. The wire management member of claim 16 wherein the body portion includes a plurality of wire grooves, the wire grooves adapted to receive wires of a cable for enabling the wires of the cable to be respectively electrically soldered to the tail of each of the terminals.

18. The wire management member of claim 16 wherein the wire management member comprises a plurality of ribs respectively disposed between two adjacent terminal grooves above the elevation of the tail of the terminals.

19. The wire management member of claim 16 wherein the body portion comprises a plurality of platforms, at least one of the platforms comprising a plurality of terminal grooves adapted to receive the tail of each of the terminals.

20. The wire management member of claim 19 wherein at least one of the platforms comprises a plurality of wire grooves adapted to receive wires of a cable.

21. An electrical connector for use with an electrical cable having a plurality of wires, the electrical connector comprising:

a connector body, the connector body comprising a front side, a rear side, a cavity between said front side and said rear side, a plurality of terminal passageways, and a plurality of terminals respectively received within the terminal passageways, the terminals each having a tail extended out of said rear side of the connector body; and a wire management member, the wire management member including a body portion having an end face, said body portion adapted to support the tail of each of the terminals and at least one wire groove for receiving at least one of the plurality of wires, the wire management member comprising a projection rod projecting from said end face of the body portion, the projection rod being received within the connector body cavity.

22. An electrical connector for use with an electrical cable having a plurality of wires, the electrical connector comprising:

a connector body, the connector body comprising a front side, a rear side, a cavity between said front side and said rear side, a plurality of terminal passageways, and a plurality of terminals respectively received within the terminal passageways, the terminals each having a tail extended out of said rear side of the connector body with a first portion of the terminals extending a distance further from the rear side of the connector body than a second portion of the terminals; and a wire management member, the wire management including a body portion having a front side and a rear side, said body portion adapted to support the tail of each of the terminals, the body portion formed to have a first platform and a second platform, the first platform adapted to support the first portion of the terminals and the second platform adapted to support the second portion of the terminals, the first platform being provided proximate to the rear side of the body portion and the second platform being provided proximate to the front side of the body portion wherein the front side of the body portion faces the rear side of the connector body.

* * * * *